US009409190B2

(12) United States Patent
Perry

(10) Patent No.: US 9,409,190 B2
(45) Date of Patent: Aug. 9, 2016

(54) PRESSURE WASHING SYSTEM FOR WET WELLS

(76) Inventor: Kenneth Richard Perry, Holland Landing (CA)

( * ) Notice: Subject to any disclaimer, the term of this patent is extended or adjusted under 35 U.S.C. 154(b) by 947 days.

(21) Appl. No.: 13/550,093

(22) Filed: Jul. 16, 2012

(65) Prior Publication Data

US 2014/0014744 A1 Jan. 16, 2014

(51) Int. Cl.

| | |
|---|---|
| ***B08B 3/02*** | (2006.01) |
| ***B05B 1/20*** | (2006.01) |
| ***B05B 13/06*** | (2006.01) |
| ***E03F 5/10*** | (2006.01) |

(52) U.S. Cl.
CPC ..... *B05B 1/205* (2013.01); *B05B 13/069* (2013.01); *B08B 3/024* (2013.01); *E03F 5/105* (2013.01)

(58) Field of Classification Search
CPC ..... E03F 5/105; E03F 9/00; E03F 9/002; E03F 9/005; E03F 9/007; B08B 3/024; B08B 9/0813; B08B 9/856; B08B 9/093; B08B 9/0936; E04G 23/002; A47L 11/38
See application file for complete search history.

(56) References Cited

U.S. PATENT DOCUMENTS

| | | | | |
|---|---|---|---|---|
| 3,449,772 | A * | 6/1969 | Werner | 4/490 |
| 3,750,686 | A * | 8/1973 | Cook | 134/95.3 |
| 5,613,511 | A * | 3/1997 | Andersen et al. | 134/167 R |

* cited by examiner

*Primary Examiner* — David Cormier
(74) *Attorney, Agent, or Firm* — Elias Borges

(57) ABSTRACT

Herein is disclosed an in-situ system for automatically washing the walls of a wet well. The system includes a high pressure water pump coupled to a plurality of elongated high pressure water spray heads mounted along the walls of the wet well. The high pressure water spray heads are each coupled to the water pump via a solenoid valve which is in turn coupled to a control panel. The control panel is configured to operate the spray heads one at a time so that the wet well is washed by operating only one spray head at a time. The system uses standard municipal water line as a water source and uses inexpensive motors, pumps and fittings.

5 Claims, 4 Drawing Sheets

PRESSURE WASHING SYSTEM FOR WET WELLS

FIELD OF THE INVENTION

The invention relates generally to in-situ systems for washing wet wells.

BACKGROUND OF THE INVENTION

Sewage treatment systems use a number of waste water holding facilities generally referred to as wet wells. Wet wells generally consist of a large tank having concrete walls. These tanks are periodically filled, or partially filled with sewage which has a tendency to deposit debris and organic matter on the walls of the wet well. Over a period of several hours, the debris and organic matter deposited on the walls of the wet well can lead to foul smells emanating from the wet well. In order to prevent the foul odors and built up crusting on the walls of the wet wells, they can be washed periodically to remove the debris and organic matter from the walls. In-situ systems for washing wet wells have usually involved the use of low pressure water sprayed to the walls in order to dislodge the debris clinging to the walls. Some systems have even employed the use of the sewage water itself to wash the walls.

While washing the walls of wet wells with municipal water (or even sewage) can be effective, the volume of water required is generally quite high. These systems require large amounts of water, large pumps, large fittings and tubing and increased installation and maintenance costs. A more efficient system which uses less water and which is less expensive to install and maintain would be beneficial.

SUMMARY OF THE INVENTION

In accordance with one aspect of the present invention, there is provided a system for automatically washing down a plurality of walls of a wet well. The system includes a high pressure water pump for creating a flow of high pressure water. An elongated header is mounted adjacent each wall of the wet well. Each elongated header is dimensioned to extend along a length of the entire wall to which it is mounted such that the elongated header spans the entire wall. The system further includes a plurality of high pressure water nozzles formed on each of the elongated headers. The high pressure water nozzles are positioned on each elongated header to wash a portion of the wall to which the elongated header is mounted adjacent to with high pressure water. Each elongated header is coupled to the high pressure water pump via a solenoid valve, with each solenoid valve being coupled to a control unit. The control unit is configured to open and close the solenoid valves such that the flow of high pressure water is directed to one elongated header at a time.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 1:
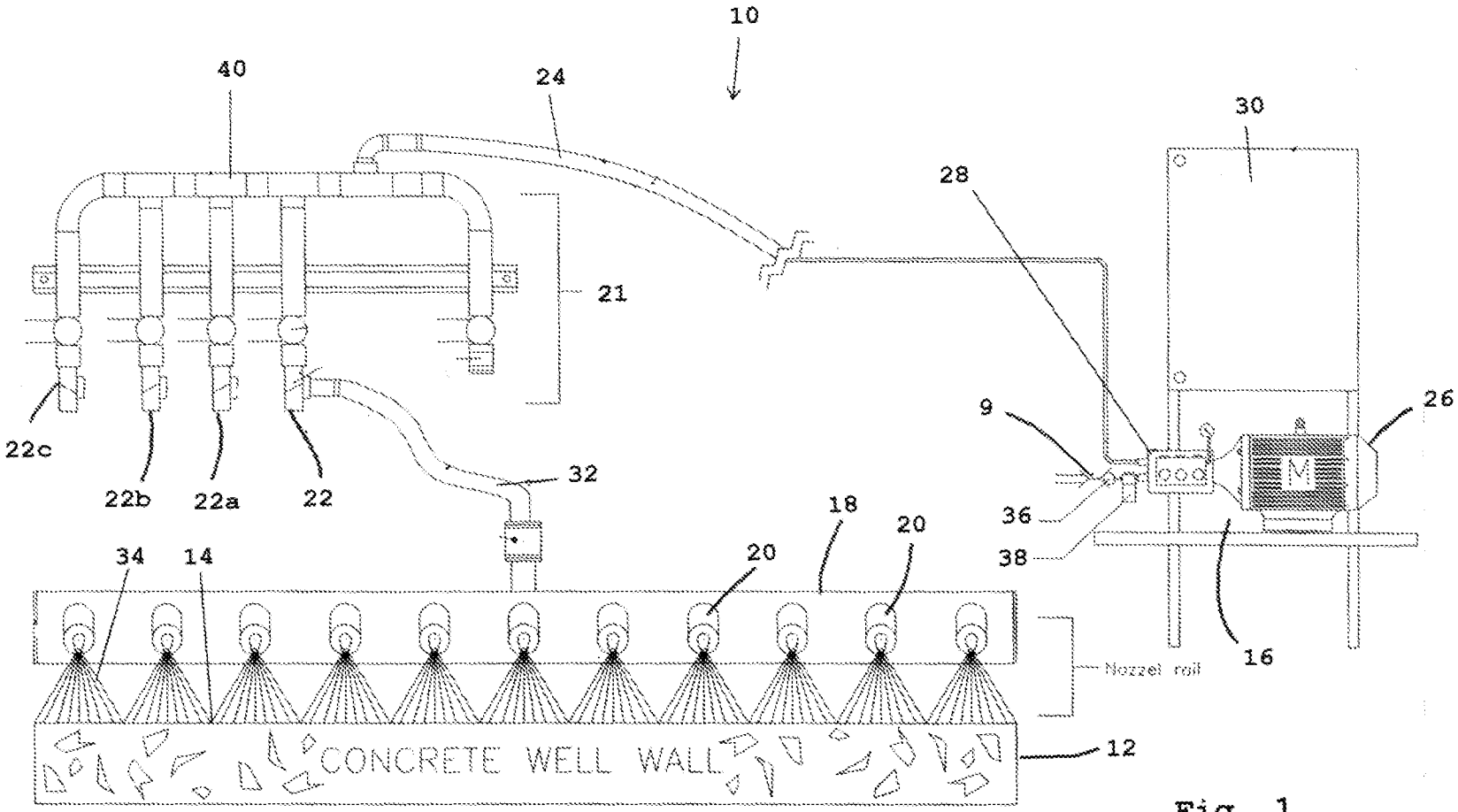
FIG. 1 is a schematic view of the system for washing a wet well made in accordance with the present invention.

Referring firstly to FIG. 1, a system for washing the walls of a wet well made in accordance with the present invention is shown generally as item 10 and consists of a high pressure water pump 16 capable of generating a flow of high pressure water, preferably from a municipal water source 9. High pressure water pump 16 is coupled to an elongated header 18 which is mounted to wall 12 of the wet well. A plurality of nozzles 20 are formed on header 18 and are positioned on the header such that the nozzles are oriented toward surface 14 of wall 12. The number, style and orientation of nozzles 20 is selected such that the high pressure streams 34 emanating from the nozzles when pump 16 is activated overlap sufficiently to clean an elongated continuous portion of surface 14 immediately adjacent header 18. Elongated header 18 is coupled to high pressure pump 16 via high pressure water lines 32 and 24 with solenoid valve assembly 21 interposed between water lines 32 and 24. Solenoid valve assembly 21 includes a plurality of solenoid valves 22, 22*a*, 22*b* and 22*c*. Each of the solenoid valves is identical and is electrically coupled to control panel 30 which controls the operation of each of the solenoid valves. Each solenoid valve operates in either a closed or open state. As in all valves, when solenoid valve 22 is in its open state, water flows through the valve and high pressure water from pump 16 can flow to header 18. When solenoid valve 22 is in its closed state, the flow of high pressure water is shut off.

Pump 16 preferably consists of an electric motor 26 coupled to a high pressure pump 28. Electric motor 26 is preferably a 10 hp motor, however any suitable electric motor and pump combination capable of delivering a flow of water at a pressure of 1000 psi and a flow rate of greater than about 10 gallons per minute will be sufficient. Such motor and pump combinations are readily available on the market from a variety of different vendors. Pump 28 is supplied by municipal water via a standard ¾ inch water line 9. A backflow preventer 36 and an inline filter 38 are preferably coupled to pump 28 between the pump and water line 9.

Figure 3:
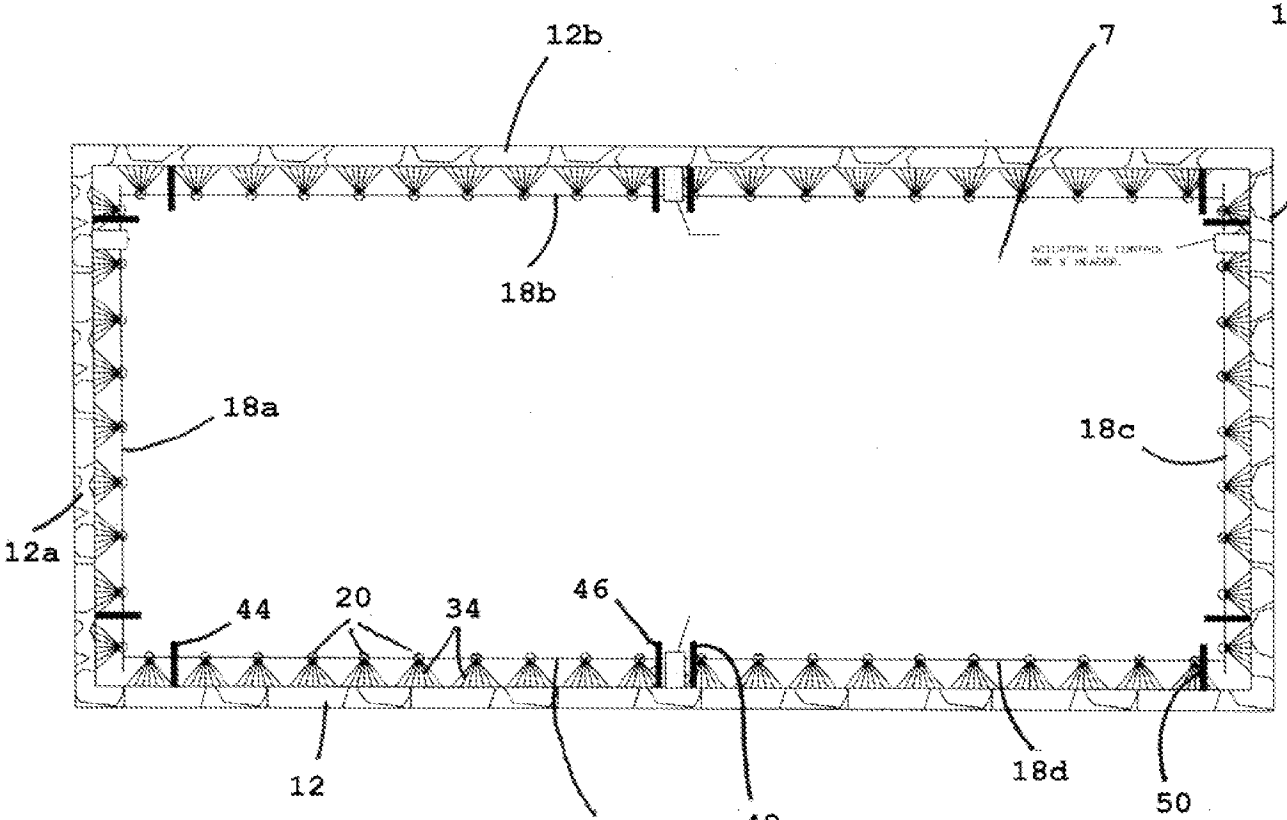
FIG. 3 is a top schematic view of the header portion of a system for washing a wet well shown in FIG. 1.
Figure 4:
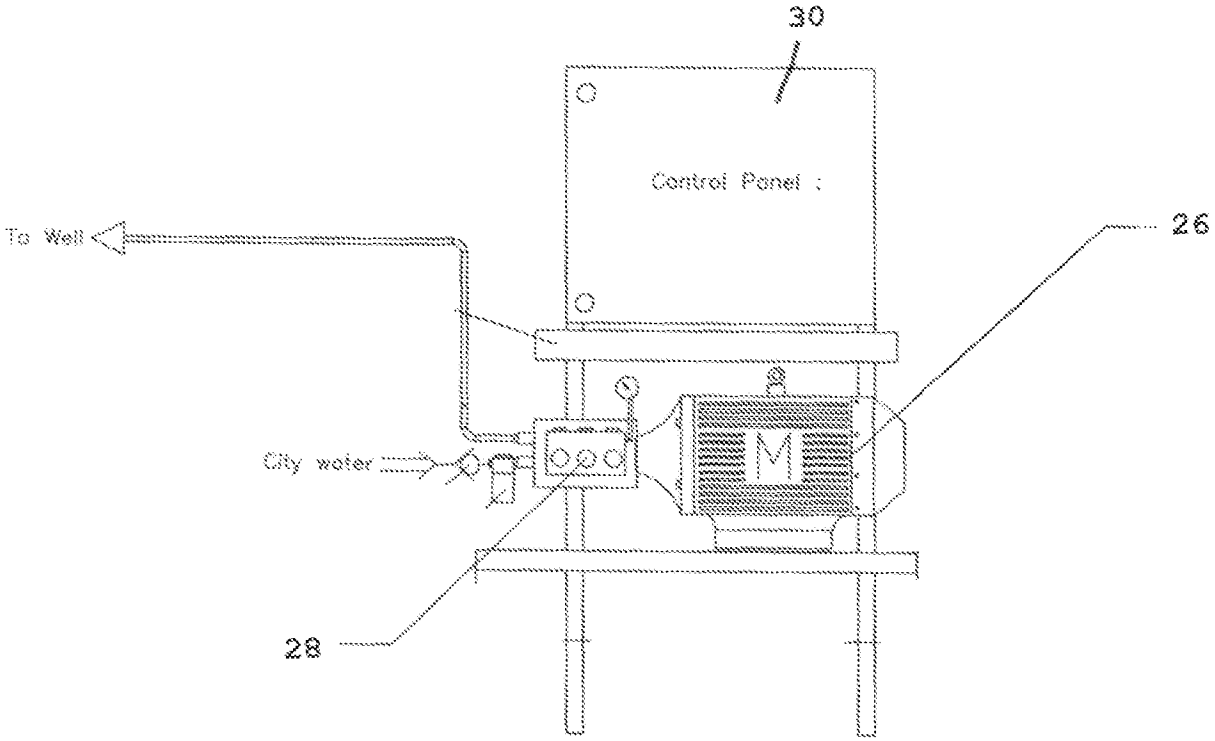
FIG. 4 is a side view of the high pressure pump portion and control unit portions of the system shown in FIG. 3.

Solenoid valve assembly 21 consists of a plurality of solenoid valves mounted on a rack or rail. One end of each solenoid valve is preferably coupled to a high pressure header 40 which is in turn coupled to high pressure water line 24 from pump 28. The other end of each solenoid valve is coupled to an elongated header via another high pressure water line. In the example shown, solenoid valve 22 is coupled to elongated header 18 via high pressure line 32. As shown in FIG. 3, a wet well may consist of a rectangular structure having four walls 12, 12*a*, 12*b* and 12*c*, with a separate header 18, 18*a*, 18*b* and 18*c* mounted to each wall, respectively. Each separate header would be coupled to the high pressure water source by a separate solenoid valve. Hence, headers 18, 18*a*, 18*b* and 18*c* in FIG. 3 would be coupled to solenoid valves 22, 22*a*, 22*b* and 22*c* in FIG. 1, respectively. In this way the flow of high pressure water to each separate header would be controlled by a separate solenoid valve. Control panel 30, as shown in FIG. 1, is coupled to each solenoid valve and controls the opening and closing of each valve. Control panel 30 is provided with a logic controller or control circuit of some kind which alternates the opening and closing of solenoid valves 22, 22*a*, 22*b* and 22*c* sequentially so that only one solenoid valve is opened at a time. This ensures that all of the high pressure water generated at pump 28 is directed to only one elongated header at a time. As a result, the wet well is washed one wall at a time. By allowing one wall to be washed at a time, the size of the high pressure pump 28 and motor 26 can be minimized and the capacity of the water source 9 can be more modest. Therefore, a standard ¾ inch water line is usually all that is required to operate the wet well washing system made in accordance with this invention.

Figure 2:
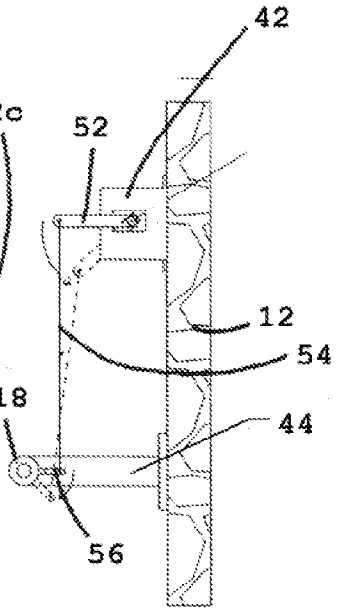
FIG. 2 is a side view of a portion of the system shown in FIG. 1 showing the pivoting system for pivoting the header portion of the invention.

Referring now to FIGS. 2 and 3, each wall in wet well 7 has at least one header mounted thereto. If the wall of the wet well is very long, then it is possible to mount two headers together in coaxial alignment in order to span the wall. Hence, wall 12 may be spanned by two elongated headers, namely headers 18 and 18*d*. Headers 18 and 18*d* are identical, and each is supported by a pair of brackets mounted to wall 12, namely brackets 44 and 46 and brackets 48 and 50, respectively. Each header is mounted to its pair of brackets such that the header can pivot along its longitudinal axis. Each header is also coupled to a pivoting mechanism as shown in FIG. 2. Pivot mechanism 42 is mounted to the wall of the wet well a few feet above the elongated header. Pivot mechanism 42 includes a pivot arm 52 which can be moved up or down (shown with dotted lines). Pivot arm 52 is coupled to lever arm 56 mounted to the elongated header by cable 54. Pivot arm 52 is pivoted up and down by an electric motor (not shown) contained within pivot mechanism 42. As pivot arm 52 raises and lowers, the header is likewise pivoted about its long axis. As the header 18 is pivoted, nozzles 20 are pivoted between two angular positions relative to the wall (i.e. pivoted up and down) and high pressure water streams 34 are directed up and down in a sweeping fashion. This up and down sweeping movement of the high pressure water sprays emanating from nozzles 20 aids in washing debris off the wall of the wet well, thereby increasing the efficiency of the wash system.

The operation of the system shall now be discussed with reference to FIG. 1 with additional features of the invention being discussed. After installation, water line 9 is opened to supply pump 28 with a source of clean municipal water at normal municipal water pressure. Control panel 30 includes a control circuit which is configured to operate the system once every few hours each day in order to wash the walls of the wet wells. For example, the control panel could be configured with a program cycle of once every four hours, meaning that the wash system is activated once every four hours or about 6 times per day. When the control panel activates the wash system, the control panel starts water pump 16 and opens one of the solenoid valves (say solenoid valve 22) while leaving all of the remaining solenoid valves closed. When solenoid valve 22 is opened, a flow of high pressure water is delivered to header 18 which causes nozzles 22 to spray high pressure water streams 34 towards surface 14 of wall 12. Preferably, nozzles 22 are each configured to deliver a flat jet of high pressure water to wall 14 which has sufficient force to physically dislodge any debris clinging to surface 14. After a time interval of two to three minutes, control panel 30 closes solenoid valve 22 and opens another solenoid valve, say solenoid valve 22*a*. After 2 to 3 minutes, control panel 30 then closes solenoid valve 22*a* and opens solenoid valve 22*b*. Solenoid valve 22*b* remains open for two to three minutes before control panel 30 closes valve 22*b* and opens solenoid valve 22*c*, and so forth. The solenoid valves are opened then closed in succession, so that only one elongated header is supplied with high pressure water at a time and only one wall, or section of a wall, is washed at a time. Each solenoid valve is opened for only an interval of time (usually only a few minutes), the duration of which is selected to ensure that the section of wall being washed at that time is cleaned adequately. After a total time period of between about 8 minutes to 30 minutes, the control panel closes the last solenoid valve and then shuts down motor 26. Control panel 30 may be further configured to activate the pivot motor associated with the header to which the solenoid valve is coupled to so that when a particular solenoid valve is activated, the header to which that valve is coupled is pivoted up and down. This maximizes the efficient and complete washing of the portion of the wall adjacent the header.

The control circuit contained in control panel 30 may consist of a standard commercially available programmable logic controller board having an onboard timer and sufficient outputs to handle all of the solenoid valves and pivot motors in addition to the pump motor. The solenoid valves may consist of standard 120 v solenoid valves which are commercially available from a number of different vendors. The number of solenoid valves will vary depending on the number of headers used, which in turn is a function of the size of the wet well being washed. For the example shown in FIG. 3, it is expected that six separate headers would be used, one header each for walls 12*a* and 12*c*, and two coaxially aligned headers for walls 12 and 12*b*. The system would therefore require six solenoid valves to ensure that only one header would be operated at a time.

Figure 7:
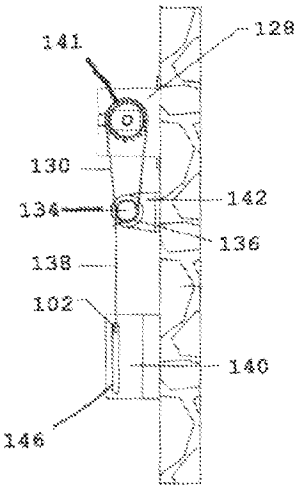
FIG. 7 is a side view of a portion of the system for washing a wet well shown in FIG. 5 showing details of the elevator system portion of the invention.
Figure 5:
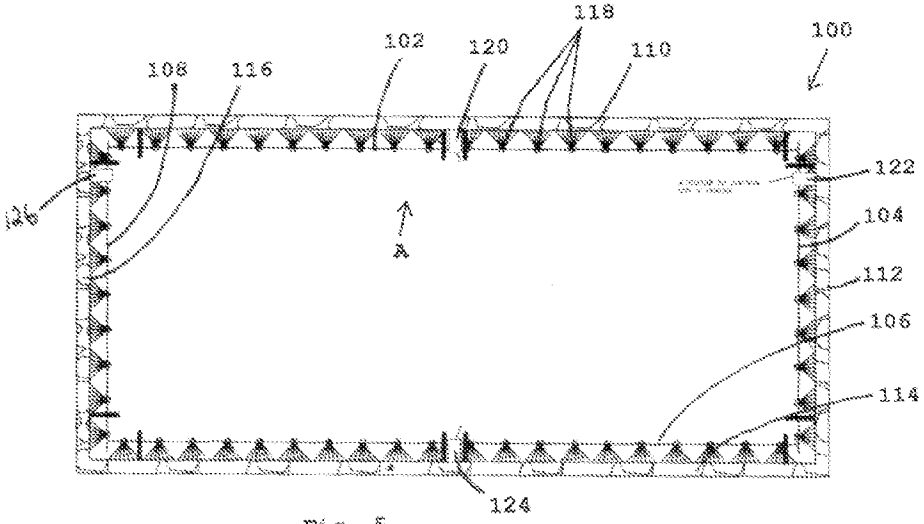
FIG. 5 is a top schematic view of the header portion of a system for washing a wet well made in accordance with another aspect of the present invention.
Figure 6:
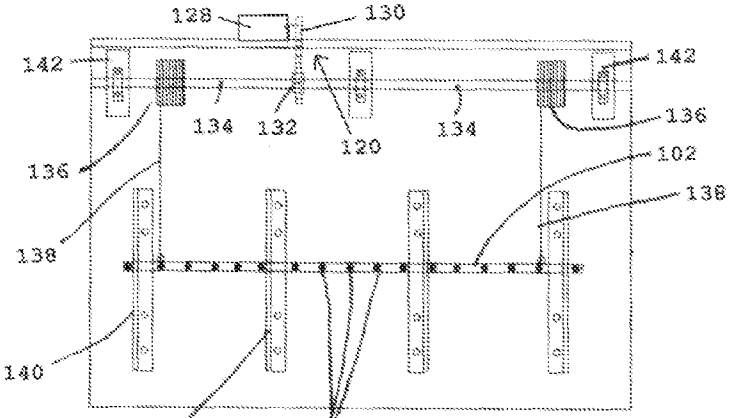
FIG. 6 is a front view taken along perspective A of the system for washing a wet well shown in FIG. 5 showing details of the elevator system portion of the invention.

Referring now to FIG. 5, an alternate embodiment of the present invention shall now be discussed. The alternate embodiment deals with an alternate means for sweeping the inside surface of the wet well by raising and lowering the headers rather than by oscillating the nozzles. System 100 consists of a plurality of headers 102, 104, 106 and 108 movably mounted to wet well walls 110, 112, 114 and 116, respectively. As in the previous embodiment, headers 102, 104, 106 and 108 consist of elongated pipes having spray nozzles 118 spaced along the headers and directed towards the walls so as to spray the walls with a blast of wash water. Elevator actuators 120, 122, 124 and 126 are coupled to headers 102, 104, 106 and 108, respectively and are configured to raise and lower the headers as required to wash a section of the walls. Referring now to FIGS. 6 and 7, each elevator actuator consists of an electric motor configured to turn a pulley coupled to its respective header so as to lift and lower the header a predetermined distance. The elevator actuators shall now be described with reference to actuator 120; however, it will be appreciated that each of the actuators are identical in structure.

Actuator 120 consists of an electric motor 128 coupled to a chain 130 via sprocket 141, which is in turn coupled to a sprocket 132 on a rotatable shaft 134 mounted to brackets 142. Pulleys 136 are fixed along shaft 134 and rotate along with the shaft. Cables 138 couple header 102 to pulleys 136 and permit the header to be raised or lowered as pulleys 136 rotate. Support brackets 140 each have elongated slot 146 to ensure that header 102 moves up and down steadily without knocking against the wall. Each electric motor 128 is coupled to a control unit (not shown) virtually identical to the control panel described with reference to the previous embodiment. When activated, all of the electric motors operate to either raise or lower the headers simultaneously. As in the previous embodiment, each header is coupled to a solenoid valve (not shown) which is in turn coupled to the control panel and to a high pressure water pump. When activated, the control panel operates the actuators to slowly raise and lower the headers while the high pressure water pump is operating so as to sweep a section of the walls of the wet well clean with the high pressure water emanating from nozzles 118. The nozzles themselves are fixed in position on the header, so instead of washing a section of the wall by oscillating, the header raises and lowers a predetermined distance such that the nozzles sweep a section of the walls. As in the previous embodiment, the solenoids (not shown) are operated so that only one section of header is fed with high pressure water at a time. While system 100 is shown in a rectangular wet well, it will be appreciated that this system of sweeping a section of wet well wall is particularly well suited with a circular wet well. Raising and lowering the headers is particularly effective where the walls of the wet well are curved, such as a circular wet well.

The present invention has several advantages over the prior art. In particular, the system uses a relatively small, inexpensive and easily serviced or replaced electric motor to drive the pump since the system only needs to wash a portion of the wet well at any time. A standard 10 hp electric motor is sufficient to operate the system at a pressure of about 1000 psi and a volume flow rate of 10 gallons per minute. The system can be scaled up to nearly any size wet well without having to use a larger water pump or motor simply by adding additional headers and solenoid valves. Furthermore, since the system uses a smaller water pump and motor, the system can utilize standard ¾ inch water lines and fittings. The system is also quicker and uses much less water. Since the pump operates for only 2 to 3 minutes per header, only about 10 minutes is required to fully wash all of the walls of the wet well. Operating the system for 10 minutes consumes only about 100 gallons of water. This makes the system economical to run. The net result is a system which is less expensive and easier to install, less expensive to operate and less expensive to maintain.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims Therefore, what is claimed is:

1. A system for washing down a walls of a wet well, the system comprising:

a. A high pressure water pump for creating a flow of high pressure water;

b. An elongated header mounted adjacent the wall of the wet well, the elongated header dimensioned to extend along a length of the entire wall such that the elongated header spans the entire wall;

c. A plurality of high pressure water nozzles formed on the elongated headers, the high pressure water nozzles positioned on the elongated header to wash a portion of the wall with high pressure water;

d. The elongated header being coupled to the high pressure water pump via a solenoid valve, the solenoid valve being coupled to a control unit, the control unit configured to open and close the solenoid valve;

e. wherein the elongated header is mounted to the wall by a pair of mounting brackets configured to permit the elongated header mounted thereto to pivot along a long axis of the elongated header, the system further comprising a pivot motor coupled to the elongated header for pivoting the elongated header such that the high pressure nozzles formed thereon are pivoted up and down in a sweeping fashion when the pivot motor is activated, the pivot motor being coupled to the control unit which is configured to activate the pivot motor in coincidence with the opening of the solenoid valve.

2. The system defined in claim 1 wherein the elongated header is divided into two coaxially aligned elongated headers mounted to the wall, each of the two coaxially aligned elongated headers being coupled to a different solenoid valve.

3. The system defined in claim 1 wherein the control unit is configured to open the solenoid valve for a predefined time interval, the predefined time interval selected to be sufficient to allow the system to wash a portion of the wall to which the elongated header is adjacent to.

4. The system defined in claim 1 wherein the elongated header is mounted to a frame, and further comprising an elevator for raising and lowering the frame within the wet well, the elevator being coupled to the control unit for controlling the raising and lowering of the frame, the control unit being further configured to raise and lower the frame coincident with the opening of the solenoid valves.

5. A system for washing down a first, second, third and fourth walls of a wet well, the system comprising:

a. A high pressure water pump for creating a flow of high pressure water;

b. A first, second, third and fourth elongated header mounted adjacent the first, second, third and fourth wall of the wet well, the first, second, third and fourth elongated headers dimensioned to span the first, second, third and fourth walls;

c. A plurality of high pressure water nozzles formed on each of the elongated headers, the high pressure water nozzles on the first, second, third and fourth elongated headers positioned to wash a portion of the first, second, third and fourth walls, respectively, with high pressure water;

d. Each elongated header being coupled to the high pressure water pump via a solenoid valve, each solenoid valve being coupled to a control unit, the control unit configured to open and close the solenoid valves such that the low of high pressure water is directed to one elongated header at a time, and e. Wherein the first, second, third and fourth elongated headers are mounted to the first, second, third and fourth walls by first, second, third and fourth pairs of mounting brackets, respectively, the first, second, third and fourth pairs of mounting brackets configured to permit the first, second, third and fourth elongated headers, respectively, to pivot along a long axis of the respective elongated header, the system further comprising a pivot motor coupled to each elongated header for pivoting said elongated header such that the high pressure nozzles formed thereon are pivoted up and down in a sweeping fashion when the respective pivot motor is activated, the pivot motors each being coupled to the control unit which is configured to activate each pivot motor in coincidence with the opening of the solenoid valve coupled to the respective elongated header.

* * * * *